US008833770B1

(12) United States Patent
Benesh

(10) Patent No.: US 8,833,770 B1
(45) Date of Patent: Sep. 16, 2014

(54) BOARD GAME METHOD AND APPARATUS FOR PROVIDING ELECTRONICALLY VARIABLE GAME PIECES

(71) Applicant: Rodney J Benesh, Cedar Rapids, IA (US)

(72) Inventor: Rodney J Benesh, Cedar Rapids, IA (US)

( * ) Notice: Subject to any disclaimer, the term of this patent is extended or adjusted under 35 U.S.C. 154(b) by 0 days.

(21) Appl. No.: 14/067,376

(22) Filed: Oct. 30, 2013

(51) Int. Cl.
*A63F 3/00* (2006.01)

(52) U.S. Cl.
CPC ..... *A63F 3/00643* (2013.01)
USPC ..... 273/288

(58) Field of Classification Search
None
See application file for complete search history.

(56) References Cited

U.S. PATENT DOCUMENTS

| | | | | |
|---|---|---|---|---|
| 6,182,967 | B1 | 2/2001 | Green | |
| 6,476,378 | B2 * | 11/2002 | Nougaret et al. | 250/227.11 |
| 6,835,131 | B1 * | 12/2004 | White et al. | 463/1 |
| 7,267,342 | B2 * | 9/2007 | Myrfors et al. | 273/288 |
| 2005/0017450 | A1 * | 1/2005 | Weisman et al. | 273/288 |
| 2005/0248091 | A1 * | 11/2005 | Neervoort et al. | 273/236 |
| 2005/0258598 | A1 * | 11/2005 | Myrfors et al. | 273/288 |
| 2007/0117602 | A1 * | 5/2007 | Madigou et al. | 463/14 |
| 2008/0004110 | A1 * | 1/2008 | Cortenraad et al. | 463/34 |
| 2008/0122175 | A1 * | 5/2008 | Deng | 273/260 |
| 2008/0211183 | A1 * | 9/2008 | Cortenraad et al. | 273/237 |
| 2009/0104988 | A1 * | 4/2009 | Enge et al. | 463/31 |
| 2013/0217496 | A1 * | 8/2013 | Olkin et al. | 463/32 |

* cited by examiner

*Primary Examiner* — Seng H Lim
(74) *Attorney, Agent, or Firm* — Simmons Perrine Moyer Bergman PLC

(57) ABSTRACT

A board game with game pieces with video displays thereon, which display character and player specific images and video, which depend upon the progress of the board game and depending upon personal characteristics of particular players of the board game. Communication between the variable game pieces is facilitated.

6 Claims, 3 Drawing Sheets

BOARD GAME METHOD AND APPARATUS FOR PROVIDING ELECTRONICALLY VARIABLE GAME PIECES

FIELD OF THE INVENTION

The present invention generally relates to board games, and more particularly relates to board games with electronics, and even more particularly relates to board games with variable electronic game pieces.

BACKGROUND OF THE INVENTION

In the past, board games have largely utilized static physical game pieces. For example, the classic board game Monopoly has utilized small cast metal pieces such as a dog, thimble, top hat, etc. Many role playing games also utilize static character-like game pieces.

While these static and cast metal game pieces may have many advantages in particular uses, they also have created challenges. One common challenge created by these designs is that they require the purchase of new game pieces if it is desired to expand the choices available. Increasing the number of static game pieces can be expensive, and then require increased storage space and a concomitant increase in the amount of time needed to dig through the various game pieces.

U.S. Pat. No. 6,182,967 is for a board game having dynamic game pieces. Described therein is a central game piece with the ability to physically attach additional parts to the central game piece to change its appearance. The changes in appearances are limited to a finite set of variable combinations and ordering of additional parts. The system does not permit a visual change in a character, e.g. a change from the dog to the hat in the Monopoly game.

Consequently, there exists a need for improved methods and apparatuses for playing board games with a large variety of visual distinct game pieces.

SUMMARY OF THE INVENTION

It is an object of the present invention to provide a board game with an electronically variable game piece.

It is another object of the present invention to provide a compact variable game piece with an electronic counter capability.

It is yet another object of the present invention to provide an ability to personalize game pieces for board games.

It is a feature of the present invention to utilize an electronic game piece with a variable electronic display device thereon.

It is an advantage of the present invention to provide for the ability to widely vary an appearance of a game piece for a board game.

The present invention is an apparatus and method for varying an appearance of a game piece, which is designed to satisfy the aforementioned needs, provide the previously stated objects, include the above-listed features, and achieve the already articulated advantages. The present invention is carried out in a manner that the amount of physical storage space needed and total number of game pieces owned can be reduced, while providing for increased ability for using visually distinct game pieces.

Accordingly, the present invention is a system for and method for playing a board game with electronic visually variable game pieces.

BRIEF DESCRIPTION OF THE DRAWINGS

The invention may be more fully understood by reading the foregoing description of the preferred embodiments of the invention, in conjunction with the appended drawing wherein.

DETAILED DESCRIPTION

Figure 1:
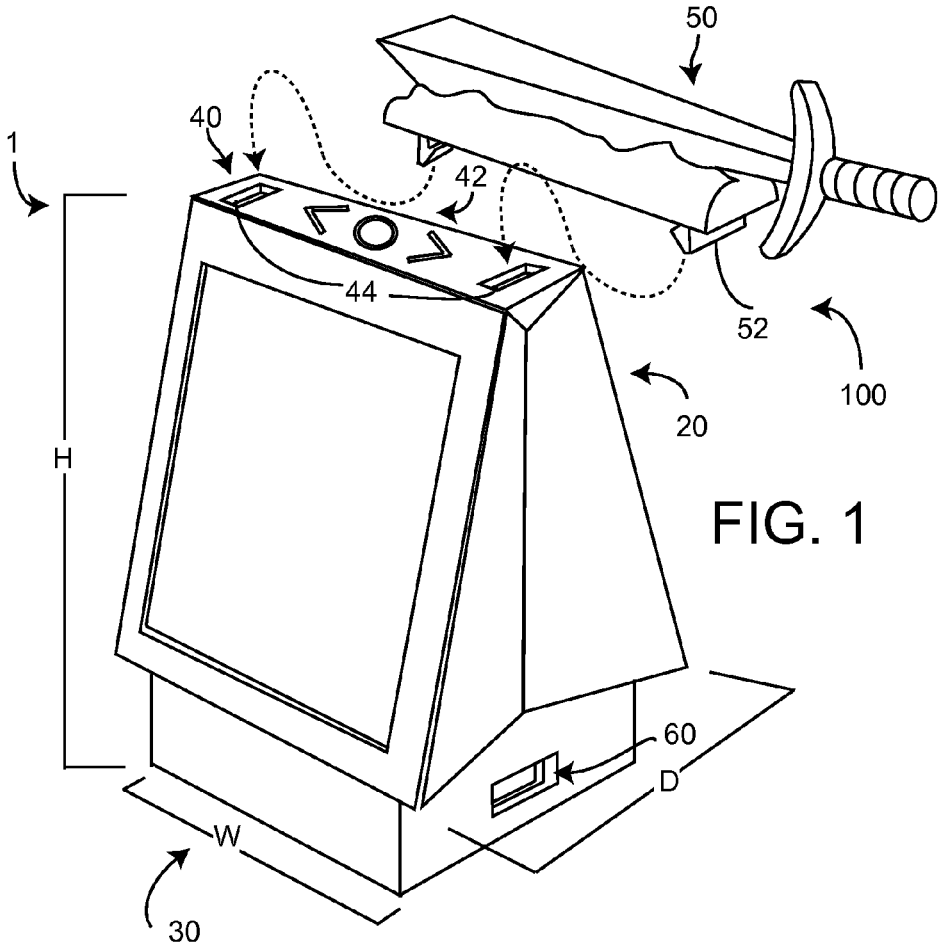
FIG. 1 is exploded perspective view of the present invention.

Now referring to the drawings, where like numerals refer to like matter throughout, the present invention relates to a novel variable game piece of the present invention. More specifically, now referring to FIG. 1 there is shown a variable game piece 100 of the present invention, which includes a variable game piece first side LCD 10 and an opposing side variable game piece second side LCD 20 (hidden from view). These displays 10 and 20 may be any type of display, but LCD displays are believed to be ideal. They may be configured to display static or video images. The variable game piece 100 may also have additional displays mounted thereon between and perpendicular to the displays 10 and 20 so that images can be displayed in all directions. Numerous other configurations could be utilized as well. The variable game piece 100 is shown with a height "H", a width "W" and a depth "D". In one embodiment of the present invention, the variable game piece 100 is less than each of 2.5 inches high (above the game board), 1.5 inches wide (at it widest point) and 1 inches long. The width and length are measured in the plane parallel to the surface of the board game game board, while the height is measured as perpendicular to both the width and the length.

Figure 4:
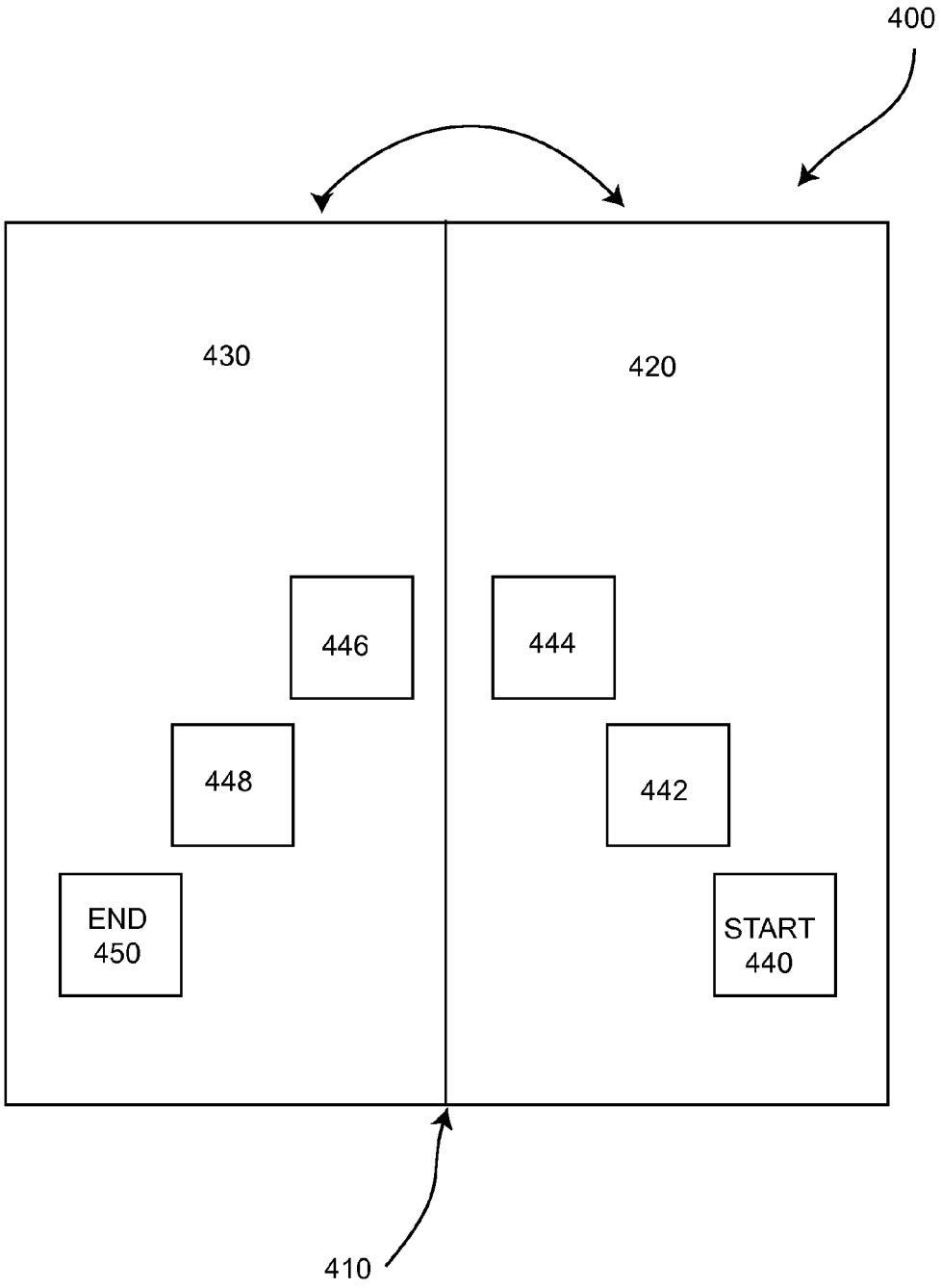
FIG. 4 is a simple drawing of a game board of the present invention.

Variable game piece 100 is shown with a housing 1 and a game piece optional detachable customization piece 50. Housing 1 includes game piece board game mating side 30, which would typically sit on the game board 400 (FIG. 4). At the opposite end of variable game piece housing 1 is game piece top side 40, which includes a game piece device controls 42, which can be used to select and move through a menu of controls and display options. Also shown is a game piece optional detachable customization piece 50, which has customization piece mating catch 52 at each end, which fits into customization piece mating hole 44 at each end of game piece top side 40. The game piece optional detachable customization piece 50 is shown to represent a vast variety of possible customization pieces for ornamental purposes. Also shown in FIG. 1 is variable game piece computer interface port 60, which may be a USB, Firewire or other data port.

Figure 2:
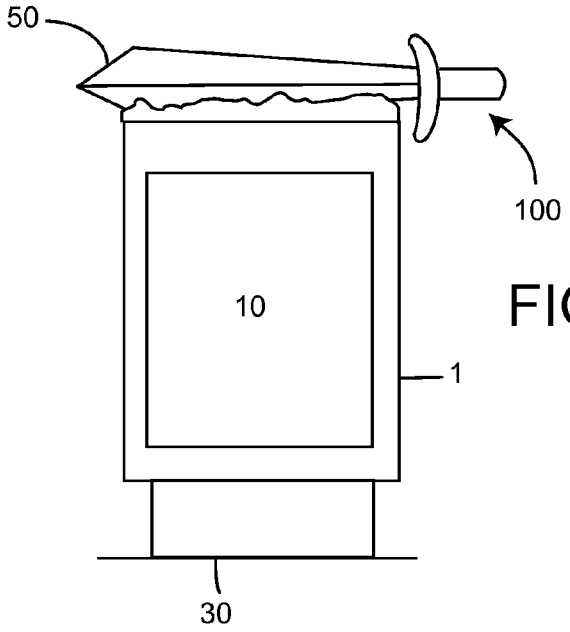
FIG. 2 is a side view of a variable game piece of FIG. 1.

FIG. 2 is assembled side view of the variable game piece 100, which includes game piece optional detachable customization piece 50 combined with variable game piece housing 1 of FIG. 1.

Figure 3:
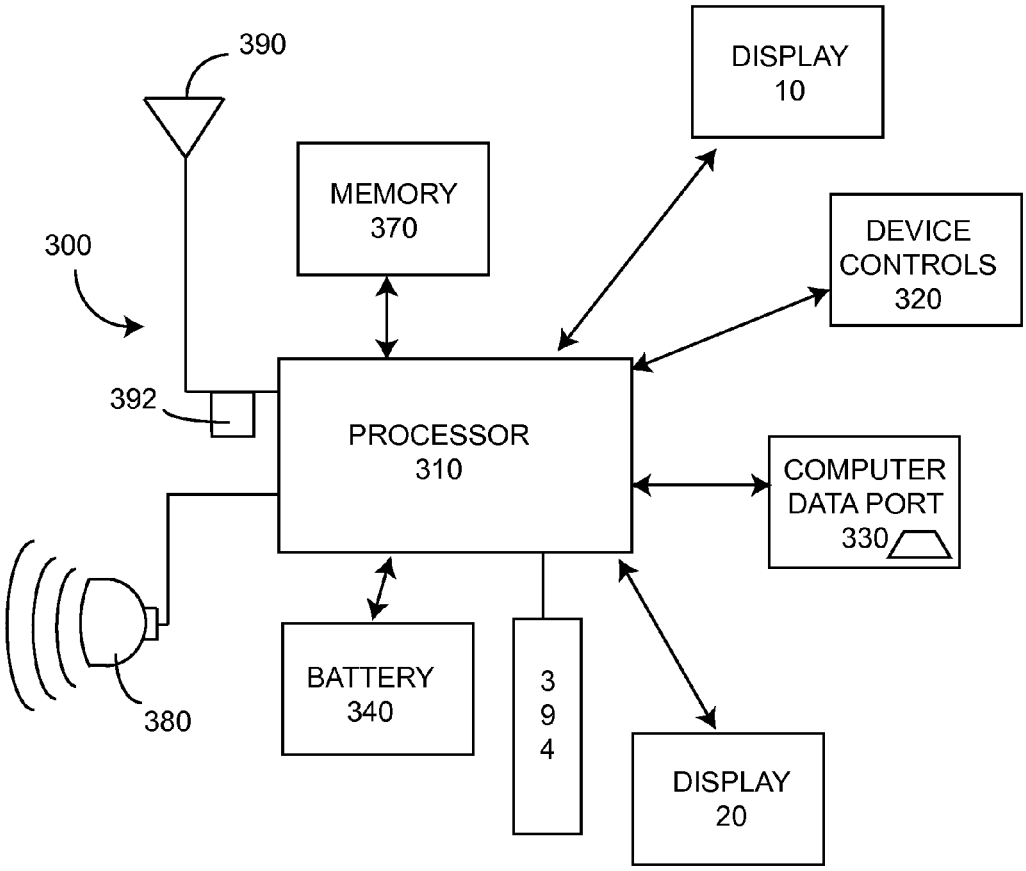
FIG. 3 is simplified block diagram view of the electronic circuitry of the variable game piece of FIG. 1.

Now referring to FIG. 3, there is shown a simplified electronic block diagram view of the circuit 300 of the present invention, which includes a processor 310 which can be a microprocessor, programmable logic device or other device or array of electronic components which can aid in execution of a predetermined algorithm.

Processor 310 is coupled to memory 370, which could store various items, such as images to be displayed on variable game piece first side LCD 10 and variable game piece second side LCD 20, as well as storage of instructions, battle videos and other data used in the operation of the variable game piece 100. A computer data port 330, which could be the variable game piece computer interface port 60 of FIG. 1, is shown as representative structure whereby data is input into or removed from the variable game piece 100. Battery 340 is shown coupled to processor 310, as is device controls 320, which could be game piece device controls 42 of FIG. 1. It should be understood that numerous forms of the variable game piece 100 could be constructed which perform the novel functions of the present invention without departing from the spirit and scope of the invention. In one embodiment, the variable game piece 100 is free of any cameras which can be configured to capture images. In one embodiment of the variable game piece 100 further includes a communication module 392 for communicating via antenna 390 with other variable game pieces with Bluetooth, Near Field Communication NFC or a Wi-Fi network, and is free of any communication ability over a mobile phone network. The variable game piece 100 may include a speaker 380 for playing messages and music and other sounds at various times. Inertial sensors 394 may include accelerometers, gyros and other orientation sensing devices. In one embodiment, the system will be free of any geo-location sensors or communication such as GPS.

The variable game piece 100 could function as follows:

The game piece device controls 42 are used to control the operation of the variable game piece 100 by selecting what and how the images to be displayed on variable game piece first side LCD 10 and variable game piece second side LCD 20 are displayed. For example, both displays 10 and 20 could show the same image or different images. The displays 10 and 20 could be configured with the game piece device controls 42, or a remote pc via variable game piece computer interface port 60 to display a numeral which is representative of a counter. For example, it could display a number corresponding to the turn of the turn taken, the player number of the player, or the time taken by the player to take an action, the collective time taken by a player during the game. Still other information could be displayed such as, but not limited to, points earned by a player, amount of life left in a player. There may be multiple numbers displayed for each character, such as points earned and life remaining. These may be organized into a main number and a sub number. Descriptive text may be included along with the numbers and the images.

Where the variable game piece 100 includes both NFC and inertial sensors, two pieces may communicate with each other when brought into close proximity, or if they are tipped individually or at the same time. In some games, the pieces may "battle" each other and display a computer simulated video representative of a battle and may make battle sounds, enhancing the game experience for the players.

The variable game piece 100 is sized and configured to be use on board games such as Monopoly, Life, Dungeons and Dragons and Pathfinder as well as similar board games. The size of the variable game piece 100 is small and can be easily used as a replacement piece for the original game pieces that are sold with such games.

The small sized variable game piece 100 may often be used with a folding game board 400, as shown in FIG. 4. There is also shown a fold area 410 which separates a first board game area 420 and a second board game area 430. The folding game board 400 may have a start position 440 and several intermediate play locations such as 442, 444, 446 and 448. An end position 450 may be included as well. Still other board configurations could be used with or without specific beginning and end locations. The variable game piece 100 is sized so that it can be placed in and or near an intermediate play location and be small enough that it is clear which play location is associated with the particular variable game piece. In some role playing games and collectable card games, the game boards have larger locations to accommodate larger game pieces. For such games, the present invention may include embodiments where the foot prints are 2×2 inches and even 3×3 inches. The height will be variable commensurate with the footprint.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

I claim:

1. A board game with a variable game piece for use on a game board of the board game where the variable game piece is used to represent a predetermined play of the board game; the board game comprising:

a variable game piece which is electronically variable comprising:

a housing; sized and configured to be placed upon a game board;

a variable game piece first side LCD coupled to said housing;

means for electronically storing a plurality of distinct images to be displayed on said variable game piece first side LCD;

means for electronically controlling operation of said variable game piece;

a second side LCD coupled to said housing and on opposites sides of said housing with respect to said first side LCD;

means for communicating with a second variable game piece;

programmable logic configured to detect the presence of a nearby second variable game piece and initiate the display of computer simulated battle video;

a speaker configured to generate sound with said computer simulated battle video; and an inertial sensor configured to determine if said variable game piece is tipped and to automatically terminate displaying a battle video when said variable game piece has been tipped on its side.

2. A board game comprising:

a game board configured for playing a board game with game pieces thereon representative of a plurality of predetermined players;

a first variable game piece comprising:

a first housing; sized and configured to be placed upon a game board within each of a plurality of non-overlapping predetermined game piece locations;

a first variable game piece first side LCD and a first variable game piece second side LCD coupled to said first housing and on opposites sides of said first housing with respect to said first variable game piece first side LCD;

first means for electronically storing a plurality of distinct images to be displayed on said first variable game piece first side LCD; and first means for electronically controlling operation of said first variable game piece;

a second variable game piece comprising:

a second housing; sized and configured to be placed upon a game board within each of a plurality of non-overlapping predetermined game piece locations;

a second variable game piece first side LCD and a second variable game piece second side LCD coupled to said second housing and on opposites sides of said second housing with respect to said second variable game piece first side LCD;

second means for electronically storing a plurality of distinct images to be displayed on said second variable game piece first side LCD; and second means for electronically controlling operation of said second variable game piece;

wherein said first means for electronically controlling operation of said first variable game piece comprises:

internal memory;

a near field communication means for receiving unique data from said second variable game piece when said first variable game piece is in communication with said second variable game piece;

a programmable logic device coupled to said internal memory and said near field communication means for generating LCD drive signals in response to said unique data;

a speaker configured to play audio signals when said LCD drive signals are video signals; and inertial sensors configured to generate a signal, which changes operation of said first variable game piece when said first variable game piece is tipped away from an upright orientation.

3. The board game of claim 2 wherein said first variable game piece is free of any GPS receiver, mobile telephone network transceiver, and a camera.

4. The board game of claim 3 wherein said first variable game piece is configured to couple with a remote electronic device which provides for an ability to re-program portions of programmable logic within said first variable game piece.

5. The board game of claim 4 wherein said first variable game piece is configured to couple with said remote electronic device via one of Wi-Fi or Bluetooth communication.

6. A board game comprising:

a game board configured for playing a board game with game pieces thereon representative of a plurality of predetermined players;

a first variable game piece comprising:

a first housing; sized and configured to be placed upon a game board within each of a plurality of non-overlapping predetermined game piece locations;

a first variable game piece first side LCD and a first variable game piece second side LCD coupled to said first housing and on opposites sides of said first housing with respect to said first variable game piece first side LCD;

first means for electronically storing a plurality of distinct images to be displayed on said first variable game piece first side LCD; and first means for electronically controlling operation of said first variable game piece;

a second variable game piece comprising:

a second housing; sized and configured to be placed upon a game board within each of a plurality of non-overlapping predetermined game piece locations;

a second variable game piece first side LCD and a second variable game piece second side LCD coupled to said second housing and on opposites sides of said second housing with respect to said second variable game piece first side LCD;

second means for electronically storing a plurality of distinct images to be displayed on said second variable game piece first side LCD; and second means for electronically controlling operation of said second variable game piece;

wherein said first means for electronically controlling operation of said first variable game piece comprises:

internal memory;

a near field communication means for receiving unique data from said second variable game piece when said first variable game piece is in communication with said second variable game piece;

a programmable logic device coupled to said internal memory and said near field communication means for generating LCD drive signals in response to said unique data;

a speaker configured to play audio signals when said LCD drive signals are video signals;

inertial sensors configured to generate a signal which changes operation of said first variable game piece when said first variable game piece is tipped away from an upright orientation;

wherein said first variable game piece is free of any GPS receiver, mobile telephone network transceiver, and a camera;

wherein said first variable game piece is configured to couple with a remote electronic device which provides for ability to re-program portions of programmable logic within said first variable game piece;

wherein said first variable game piece is configured to couple with said remote electronic device via one of Wi-Fi or Bluetooth communication;

wherein said first variable game piece has a height "h" less than 3 inches and a maximum width "w" less than 2 inches and a maximum depth "d" less than 2 inches; and wherein said first variable game piece has a flat bottom configured to rest upon the game board where the flat bottom has an area of less than 1.0 square inches.

* * * * *